US006815604B2

(12) United States Patent
Toda

(10) Patent No.: US 6,815,604 B2
(45) Date of Patent: Nov. 9, 2004

(54) ELECTRONIC PERCUSSION INSTRUMENT

(75) Inventor: Jiro Toda, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 10/419,753

(22) Filed: Apr. 22, 2003

(65) Prior Publication Data

US 2003/0200860 A1 Oct. 30, 2003

(30) Foreign Application Priority Data

Apr. 24, 2002 (JP) ..... 2002-122672

(51) Int. Cl.[7] ..... G10H 1/32; G10H 3/00
(52) U.S. Cl. ..... 84/746; 84/723
(58) Field of Search ..... 84/600, 723, 725, 84/730, 104, 107, 113, 411 R, 402, DIG. 24

(56) References Cited

U.S. PATENT DOCUMENTS 5,028,776 A * 7/1991 Forti et al. ..... 250/229
5,262,585 A * 11/1993 Greene et al. ..... 84/645
5,438,903 A * 8/1995 Cropek ..... 84/422.3
5,453,567 A * 9/1995 Brinson ..... 84/104
5,915,289 A * 6/1999 Hart ..... 84/738
5,994,634 A * 11/1999 Cady ..... 84/421
6,075,197 A * 6/2000 Chan ..... 84/730

* cited by examiner

*Primary Examiner*—Marlon T. Fletcher
(74) *Attorney, Agent, or Firm*—Dickstein, Shapiro, Morin & Oshinsky, LLP.

(57) ABSTRACT

An electronic percussion instrument is constituted by a hi-hat, a stand, and a foot pedal, wherein the hi-hat is interlocked with the foot pedal via a movable shaft. In the hi-hat, a core plate (and a core) is arranged in the upper portion, and membrane switches are arranged in the lower portion and are covered with a rubber block, which is gradually brought into contact with membrane switches when depressed by the core plate, which is moved downwards upon depression of the foot pedal. In response to a depressed position of the foot pedal, membrane switches are sequentially turned on or off, thus producing a control signal whose value is varied to control an electronic sound in tone color. Thus, it is possible to produce various hi-hat sounds such as an open hi-hat sound, a closed hi-hat sound, and a foot hi-hat sound as necessary.

13 Claims, 5 Drawing Sheets

ELECTRONIC PERCUSSION INSTRUMENT

BACKGROUND OF THE INVENTION

1. Field of the Invention

This invention relates to electronic percussion instruments such as electronic drums that electronically produce sounds simulating sounds of acoustic drum sets including drums and cymbals.

2. Description of the Related Art

In electronic drums representing electronic percussion instruments, when pads (e.g., drumheads) having striking surfaces are struck with sticks (or striking rods) so that striking intensities are detected by percussion sensors (or impact sensors) such as piezoelectric sensors attached to backs of pads, electronic sound sources are activated in response to detection signals so as to produce electronic sounds simulating sounds of acoustic drums. An electronic drum set includes a variety of pads, which arc arranged around a player (or a user) and which are respectively set in different tone colors to produce different sounds from electronic sound sources, thus simulating sounds of different types of acoustic drums such as a bass drum and a snare drum when struck. Therefore, the player (or user) can play such an electronic drum set similarly to an acoustic drum set.

By the way, hi-hat cymbals (simply referred to as hi-hats) are essential in performance of acoustic drum sets having bass drums and snare drums, so that electronic drum sets also include hi-hats simulating hi-hat cymbals of acoustic drum sets.

In general, a hi-hat of an acoustic drum set is constituted by a pair of cymbals, which are operated to open or close in response to depression of a foot pedal (or a hi-hat controller), wherein different sounds may be produced when struck with a stick in response to different values of depression applied to the foot pedal. There are provided various playing techniques, called a closed hi-hat and an open hi-hat, wherein a sharp sound is produced in a closed hi-hat by depressing the foot pedal to the lowest position in a stroke in order to keep rhythm in performance, and sustained sound, whose duration is sustained longer, is produced in an open hi-hat by not depressing the foot pedal. That is, it is possible to realize accents or stresses in playing drums and cymbals by combining these techniques. In addition, there is also provided another playing technique called a foot hi-hat in which a pair of cymbals mutually collide with each other to produce sound by simply depressing the foot pedal without using a stick for striking the hi-hat. That is, a variety of techniques are available to the player (or user) in playing a hi-hat of an acoustic drum set.

In order to realize various techniques in a hi-hat included in an electronic drum set similarly to a hi-hat of an acoustic drum set, it is necessary to arrange various electronic sound sources having different tone colors, which are selectively used as necessary. That is, it may be possible to actualize various examples of electronic percussion instruments realizing various types of hi-hat sounds.

For example, it is possible to actualize an electronic percussion instrument that can selectively produce different electronic sounds upon striking of a struck member (e.g., a hi-hat) in response to results of detection as to whether or not a foot pedal is operated by a player (or a user); therefore, it is possible to selectively produce so-called "closed hi-hat sound" and "open hi-hat sound".

In addition, it is possible to actualize another electronic percussion instrument that can produce desired sound upon selection of three types of sound source circuits under the control of a CPU receiving a signal representing a striking intensity of a hi-hat struck with a stick and a signal representing a depressed position of a foot pedal, which is detected by a membrane switch attached to the foot pedal.

In the aforementioned electronic percussion instrument, when a hi-hat is struck with a stick under conditions in which the foot pedal is depressed to the lowest position, a sound source circuit realizing closed hi-hat sound is activated to produce closed hi-hat sound in response to a striking intensity applied to the hi-hat using the stick. Under conditions in which the foot pedal is not depressed to the lowest position, a sound source circuit realizing open hi-hat sound is activated to produce open hi-hat sound in response to a striking intensity and a depressed position of the foot pedal. When the foot pedal is depressed to the lowest position but a hi-hat is not struck with a stick, a sound source circuit realizing foot hi-hat sound is activated to produce foot hi-hat sound in response to the velocity at which the foot pedal is depressed.

In the former electronic percussion instrument for selectively producing different electronic sounds upon detection, whether or not the foot pedal is depressed, it is possible to selectively produce closed hi-hat sound or open hi-hat sound; however, it is impossible to produce intermediate sounds whose property lies between the closed hi-hat sound and open hi-hat sound, and it is impossible to produce foot hi-hat sound.

In the latter electronic percussion instrument for selectively activating three types of sound source circuits, it is possible to selectively produce closed hi-hat sound, open hi-hat sound, and foot hi-hat sound, wherein a membrane switch is attached to a foot pedal, which should be arranged independently of a pad having a striking surface. That is, it is very difficult for the player (or user) to experience real performance feelings as if the player actually plays a hi-hat of an acoustic percussion instrument. When playing a hi-hat of an acoustic percussion instrument, the player operates a foot pedal to control a pair of cymbals, which approach each other or depart from each other. In contrast, the electronic percussion instrument is designed in such a way that a hi-hat is arranged independently of a foot pedal; therefore, the player may have difficulties in experiencing real performance feelings as if the player actually controls movement of the hi-hat by operating the foot pedal.

Electronic percussion instruments are frequently used as replacements of acoustic percussion instruments, wherein electronic percussion instruments may be played similarly to acoustic percussion instruments in orchestras and bands. Therefore, it is necessary to realize various playing techniques on electronic percussion instruments similarly to acoustic percussion instruments. That is, it is very important that electronic percussion instruments not only simulate sounds of acoustic percussion instruments but also provide players with real performance feelings similar to those of acoustic percussion instruments,

SUMMARY OF THE INVENTION

It is an object of the invention to provide an electronic percussion instrument having a hi-hat that can produce a variety of sounds using a foot pedal similarly to a hi-hat of an acoustic percussion instrument, wherein it is possible to provide a player (or a user) in playing an electronic percussion instrument with real performance feelings similar to those of an acoustic percussion instrument.

An electronic percussion instrument is constituted by a hi-hat, a stand, and a foot pedal, which are integrally interconnected together in a vertical direction, wherein the hi-hat is composed of a lower portion and an upper portion, which is interlocked with the foot pedal via a movable shaft penetrating through a main pipe of the stand. The upper portion has a core plate (and a core) whose weight substantially equals to weight of a cymbal of a hi-hat of an acoustic percussion instrument. Membrane switches having contacts are arranged on the surface of the lower portion and are covered with a rubber block, which is normally floating above membrane switches but is gradually brought into contact with membrane switches when depressed by the core plate, which is moved downwards upon depression of the foot pedal. In response to depressed positions of the foot pedal controlled by a player's foot, contacts of membrane switches are sequentially turned on or off, thus producing a control signal whose value is varied to control an electronic sound in tone color. Thus, it is possible to produce a variety of hi-hat sounds such as an open hi-hat sound, a closed hi-hat sound, and a foot hi-hat sound as necessary.

In addition, the hi-hat interlocked with the foot pedal via the movable shaft is adjusted in weight and shape to provide the player (or user) with real performance feelings similar to those of a hi-hat of an acoustic percussion instrument.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

This invention will be described in further detail by way of examples with reference to the accompanying drawings.

Figure 2:
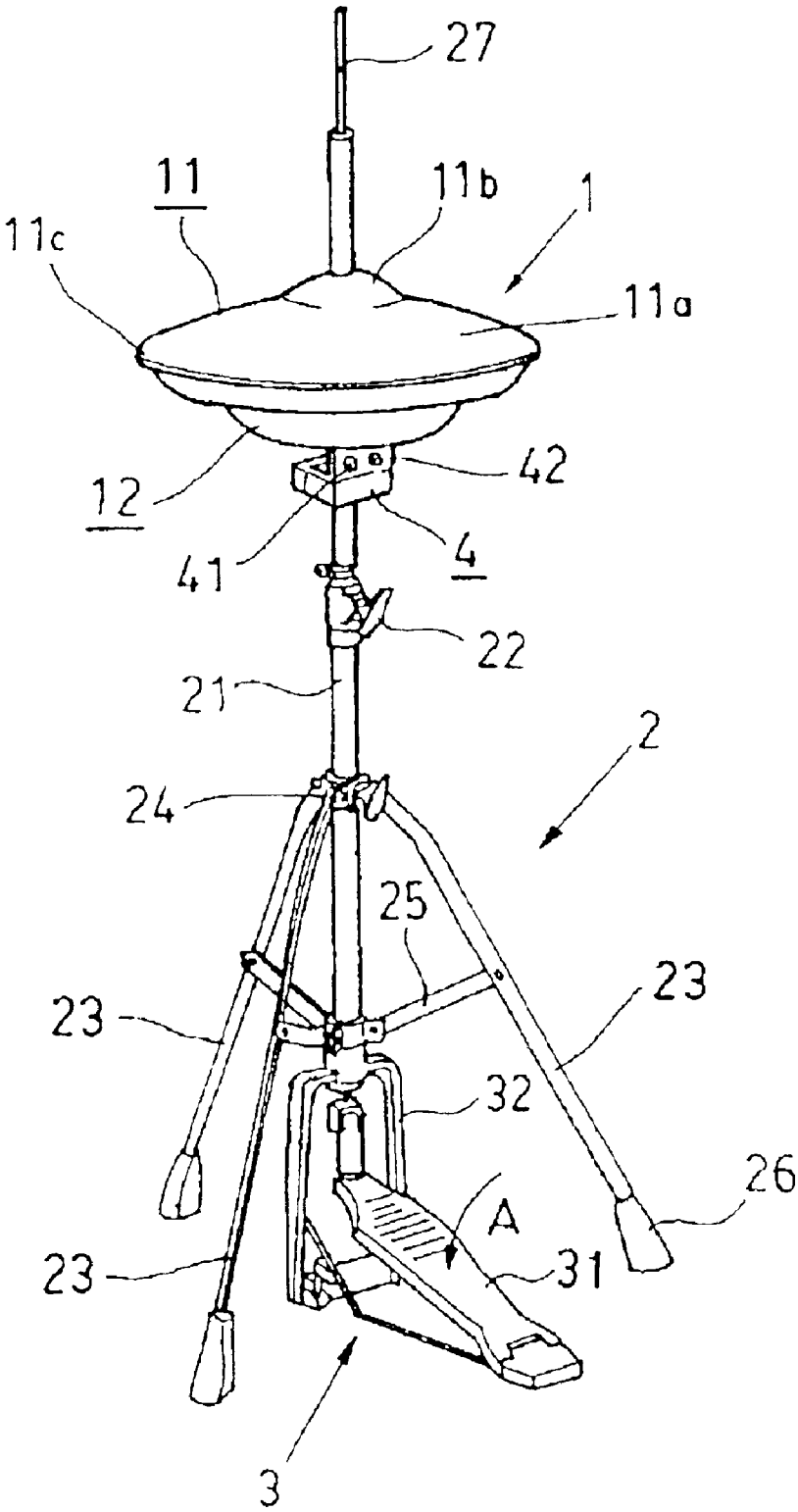
FIG. 2 is a perspective view showing the overall appearance of the electronic percussion instrument whose hi-hat is shown in FIG. 1.

FIG. 2 is a perspective view showing the overall structure of an electronic percussion instrument in accordance with a preferred embodiment of the invention.

That is, an electronic hi-hat shown in FIG. 2 is constituted by a hi-hat 1, a (tripod) stand 2 for supporting the hi-hat 1 at a desired height, at which a player (or a user) can easily strike the hi-hat 1 with a stick (not shown), and a pedal unit 3 having a foot pedal 31, which is arranged beneath the stand 2.

The stand 2 is constituted by a main pipe 21 that can be extended and shortened and is fixed by a lock screw 22, a set of three legs 23 for supporting the main pipe 21 to stand vertically on the floor, an upper fixing member 24 for collectively fixing upper ends of the three legs 23 to the main pipe 21 at a desired position, which can be adjusted, and a set of three stays 25 for connecting together intermediate portions of the legs 23 and a lower end of the main pipe 21. Rubber feet 26 are attached to lower ends of the legs 23 respectively.

A movable shaft 27 is arranged inside of the main pipe 21 in such a way that the upper end thereof penetrates through the center of the hi-hat 1 and projects upwardly. The upper end of the movable shaft 27 is not necessarily projected above from the hi-hat 1, whereas the movable shaft 27 should have a prescribed length that allows a control signal output device 5, details of which will be described later, to operate within the hi-hat 1. The lower end of the movable shaft 27 projects downwardly from the main pipe 21 and is interconnected with the front end portion of the foot pedal 31 of the pedal unit 3. A spring (not shown) is arranged between the movable shaft 27 and the main pipe 21 so that the movable shaft 27 is normally pressed upwards. The lower end of the main pipe 21 is fixed to a frame 32 of the pedal unit 3.

When the foot pedal 31 of the pedal unit 3 is depressed in a direction A, the movable shaft 27 is forced to descend down against upward pressure of the spring applied thereto. When the foot pedal 31 is not depressed, the movable shaft 27 is pressed upwards. Therefore, the movable shaft 27 moves downwards or upwards when the foot pedal 31 is depressed or released.

The aforementioned structures of the stand 2 and the pedal unit 3 are similar to those of a hi-hat stand and a foot pedal of an acoustic percussion instrument.

The hi-hat 1 is constituted by a disk-like upper portion 11, which is slightly curved in a convex manner and which is formed like a cymbal of an acoustic percussion instrument, and a dish-like lower portion 12 having a flange for supporting the upper portion 11. The upper portion 11 of the hi-hat 1 contains three parts integrally formed together, namely, a striking surface 11*a*, a cup 11*b* corresponding to a cymbal cup, which is formed at the center of the striking surface 11*a*, and an edge 11*c* corresponding to a cymbal edge, which is formed in the outer circumference. Details of the hi-hat 1 will be described later.

A jack box 4 is arranged beneath the lower portion 12 of the hi-hat 1, wherein it has a jack 41 for outputting a control signal in response to an operation of the foot pedal 31 and a jack 42 for outputting a percussion detection signal. Plugs of connection cables (not shown) are inserted into the jacks 41 and 42, so that the hi-hat 1 is connected with a musical tone generator (not shown) for electronically generating musical tones (or hi-hat sounds).

The lower portion 12 of the hi-hat 1 and the jack box 4 are both fixedly attached to the upper portion of the main pipe 21 of the stand 2.

Details of the hi-hat 1 will be described with reference to FIG. 1, which is a cross sectional view taken along a diameter line of the hi-hat 1.

In the upper portion 11 of the hi-hat 1, the surface of a disk-like metal base 11A, which is slightly curved in a convex manner, is covered with a rubber cover 11B, wherein a through hole 11*d* is formed at the center of the metal base 11A. The metal base 11A and the rubber cover 11B join together to form the aforementioned three parts of the upper portion 11 of the hi-hat 1, namely, the striking surface 11*a*, cup 11*b*, and edge 11*c*.

The lower portion 12 of the hi-hat 1 is constituted by a bottom 12*a* and a flange 12*b* integrally formed together, wherein the "stepped-cone-like" flange 12*b* is formed in the circumference of the "flat-disk-like" bottom 12*a*, so that the lower portion 12 as a whole is formed like a deep dish or a bowl made of a metal. The bottom 12*a* of the lower portion 12 is fixedly attached to the main pipe 12 in a horizontal manner together with the jack box 4. In addition, the periphery of the flange 12*b* of the lower portion 12 joins the periphery of the base 11A of the upper portion 11 via buffer materials 13 such as rubber materials, wherein joining areas therebetween are entirely covered with the rubber cover 11B.

As described above, the upper portion 11 and the lower portion 12 integrally join together to construct the hi-hat 1. The upper portion of the movable shaft 27 of the stand 2 penetrates through the lower portion 12 and projects upwardly through a core 55, which will be described later, above the opening of the through hole 11*d* of the upper portion 11.

Percussion sensors 14 such as piezoelectric elements are adhered to intermediate positions of the backside of the base 11A (opposite to the striking surface 11*a*) of the upper portion 11 via vibration absorbing materials 15 such as rubber materials, wherein adhesive agents can share functions of the vibration absorbing materials 15. In the present embodiment, a plurality of percussion sensors 14 are arranged with equal distances from the center of the base 11A in order to uniformly detect strikes of the hi-hat 1 at any positions on the surface of the upper portion 11, so that percussion detection signals respectively produced by the percussion sensors 14 are added together. Of course, at least one percussion sensor 14 is required and is arranged at an arbitrary position of the base 11A. Using the aforementioned percussion sensors 14, it is possible to detect striking intensities of the striking surface 11*a* of the hi-hat 1 as well as striking intensities of the cup 11*b* and the edge 11*c*.

Membrane switches 16 for "edge" tone colors are arranged in a ring manner over the entire circumference of the edge 11*c* between circumferential ends of the base 11A and circumferential ends of the cover 11B. In addition, membrane switches 17 for "cup" tone colors are arranged in a ring manner beneath the cup 11*d* between the center portion of the base 11. A and the center portion of the cover 11B.

When the edge 11*c* is struck with a stick, the membrane switches 16 for edge tone colors are turned on to output an edge select signal. When the cup 11*b* is struck with a stick, the membrane switches 17 for cup tone colors are turned on to output a cup select signal. Percussion detection signals produced by the percussion sensors 14 together with the aforementioned select signals are output from the jack 42 of the jack box 4 and are supplied to the musical tone generator, which in turn produces edge hi-hat sound and cup hi-hat sound. The aforementioned membrane switches are not necessarily essential for this invention; therefore, they can be omitted from the illustration of the hi-hat 1 shown in FIG. 1.

Next, details of the control signal output device 5 for outputting a control signal in response to pedal operation, which is essential for this invention, will be described with reference to FIGS. 3 to 5.

Figure 3:
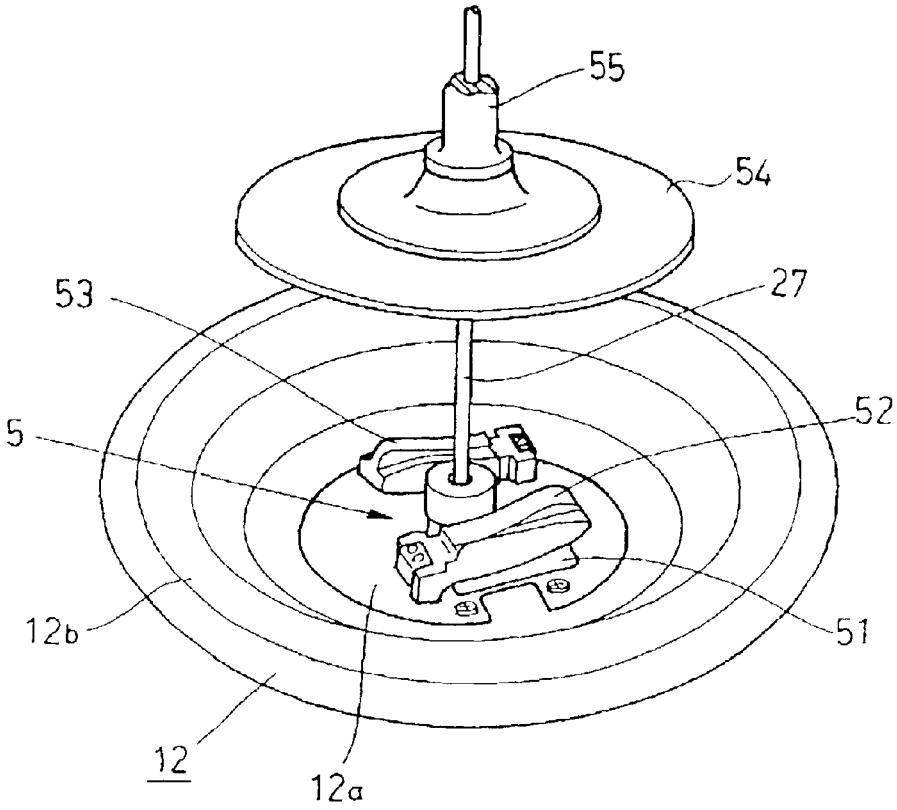
FIG. 3 is a perspective view showing the structure of the hi-hat in which a core plate is located above a lower portion of the hi-hat.

FIG. 3 is a perspective view showing the lower portion of the hi-hat accompanied with a core plate; FIG. 4 is a perspective view showing membrane switches covered with a rubber block; and FIG. 5 shows an example of circuitry, using membrane switches, for generating control signals.

Figure 1:
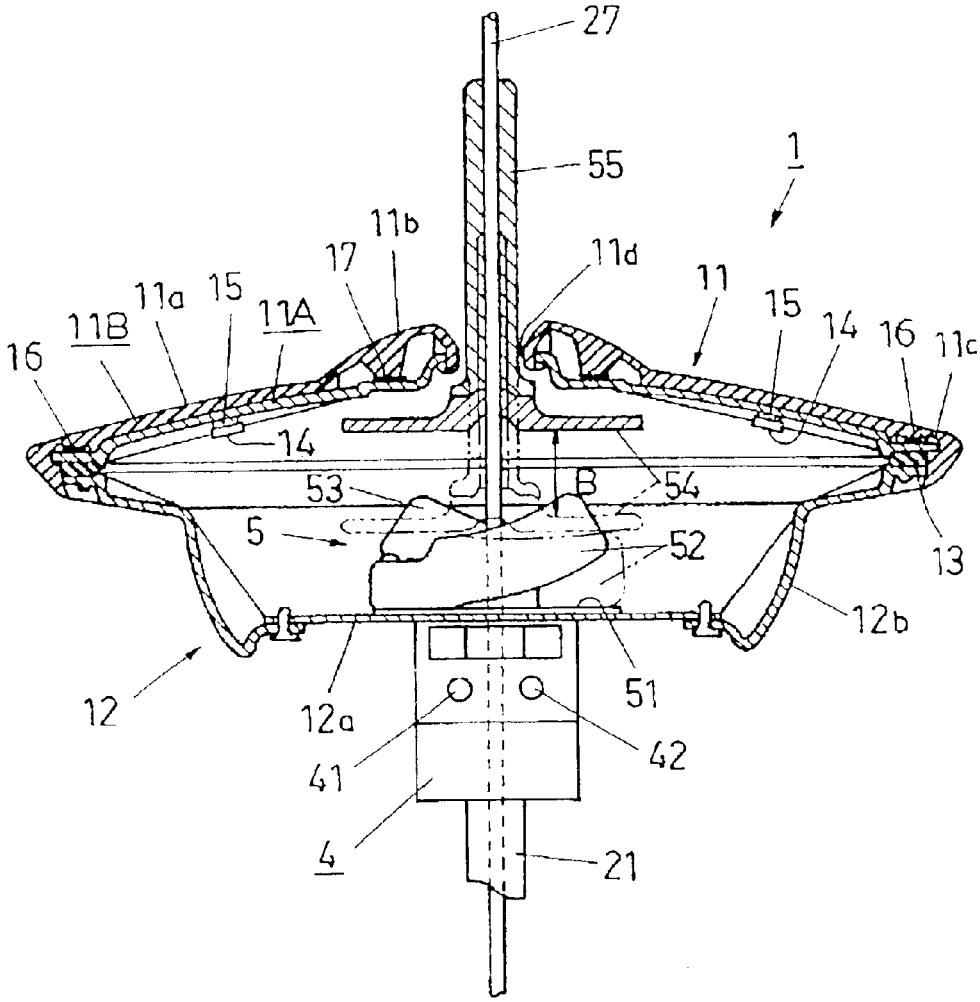
FIG. 1 is an enlarged cross sectional view showing the structure of a hi-hat of an electronic percussion instrument in accordance with a preferred embodiment of the invention.

As shown in FIGS. 1 to 3, the control signal output device 5 of the present embodiment is constituted by membrane switches 51 (i.e., SW1–SW4), a rubber block 52 that is made of an elastic material to turn on or off the membrane switches 51, a disk-shape core plate 54 for pressing the rubber block 52 to operate, and a cylindrical core 55 whose lower end portion is fixedly attached to the core plate 54. Both the core plate 54 and the core 55 are made of a prescribed metal material and are combined together to have a prescribed mass (or weight) substantially equal to that of a movable cymbal of an acoustic percussion instrument.

Reference numeral 53 designates a dummy rubber block, which is arranged to establish a prescribed balance with respect to the rubber block 52, which is pressed by the core plate 54. The rubber block 53 and the dummy rubber block 54 are placed at symmetrical positions with respect to the movable shaft 27 and are driven by the core plate 54 in a similar manner. For this reason, both the rubber block 52 and the dummy rubber block 53 are made of the same material and are formed in the same shape, wherein they are arranged symmetrically to each other about the center of the lower portion 12 of the hi-hat 1.

As shown in FIG. 2, the movable shaft 27 penetrates through the center of the hi-hat 1 to freely move in a vertical direction, wherein the core 55 is fixedly attached to the upper portion of the movable shaft 27 in a coaxial manner.

Therefore, when the movable shaft 27 moves up or down in response to a player's operation of the foot pedal 31 of the pedal unit 3, the core 55 correspondingly moves up or down, so that the core plate 54 accompanied with the core 55 moves up or down within a stroke between an upper-limit position (indicated by solid lines in FIG. 1) and a lower-limit position (indicated by imaginary lines or dashed lines in FIG. 1) in directions denoted by a bidirectional arrow 'B'.

The aforementioned membrane switches 51 and the rubber block 52 will be described in detail. The membrane switches 51 function as sensors for generating signals in response to displacement or deformation of the rubber block 52 made of an elastic material. As shown in FIGS. 1 to 3, the membrane switches 51 are adhered to the surface of the bottom 12*a* of the lower portion 12 of the hi-hat 1. In addition, the rubber block 52 whose one end is fixedly attached to a prescribed position of the surface of the bottom 12*a* in proximity to an arrangement of the membrane switches 51 is arranged above the membrane switches 51.

Figure 4:
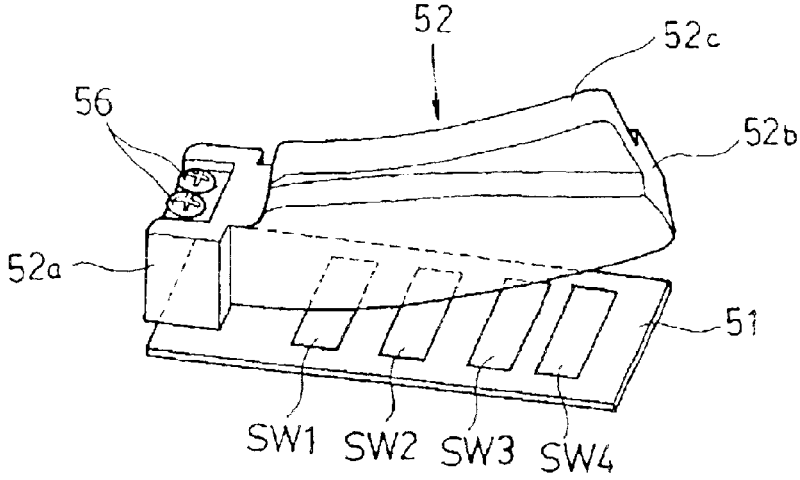
FIG. 4 is an enlarged perspective view showing an assembly of a rubber block and membrane switches attached onto a bottom of the lower portion of the hi-hat.

As shown in FIG. 4, the rubber block 52 is slightly warped upwards like a circular arc and is formed in a block shape. In order to realize upwardly curving, a base portion 52*a* of the rubber block 52 is fixed to a prescribed position of the bottom 12*a* of the hi-hat 1 by screws 56; therefore, other portion of the rubber block 52 except the base portion 52*a* is normally floated above the surface of the bottom 12*a*, so that the rubber block 52 is normally apart from the membrane switches 51, wherein a distance between each of the membrane switches 51 and the "upwardly curved" lower surface of the rubber block 52 becomes great in a direction towards a free end 52*b* of the rubber block 52. In addition, an elongated projection 52*c* having a circular arc shape, which is to be depressed by the core plate 54, is formed in a longitudinal direction along the center in a width direction of the upper surface of the rubber block 52. The end of the elongated projection 52 in the side of the free end 52*b* of the rubber block 52 approaches most proximate to the core plate 54.

The membrane switches 51 are generally constituted by a pair of electrode sheets, in which contacts and wiring patterns are subjected to screen printing using conductive materials on insulating sheets and which are arranged slightly apart from each other via a spacer in such a way that oppositely arranged contacts do not normally conduct to each other, wherein when contacts are depressed to come in contact with each other, electric conduction is established therebetween. In the present embodiment, each of the membrane switches 51 is formed as a thin rectangular element, wherein four contacts SW1, SW2, SW3, and SW4 are arranged in parallel in a longitudinal direction and are respectively distanced from each other.

Thus, the membrane switches 51 are sequentially turned on or off in a step-by-step manner as the rubber block 52 made of an elastic material is pressed by the core plate 54 and is gradually deformed so that the free end 52*b* gradually moves downwards.

Due to descending of the core plate 54, the free end 52*b* of the rubber block 52 is deformed and pressed downwards, so that the lower surface of the rubber block 52 sequentially comes in contact with the membrane switches 51 constituted by the contacts SW1, SW2, SW3, and SW4 from the base portion 52*a* thereof, so that these contacts SW1–SW4 are sequentially pressed and turned on in order.

In contrast, as the core plate 54 ascends, the rubber block 52 is elastically restored to release deformation thereof so that the free end 52*b* gradually moves upwards to sequentially release pressures applied to the membrane switches 51 thereby, wherein the lower surface of the rubber block 52 sequentially departs from the membrane switches 51 in a reverse order, i.e., SW4, SW3, SW2, and SW1, which are thus sequentially turned off in order.

When the player does not at all depress the foot pedal 31 of the pedal unit 3, the core plate 54 is initially located at the upper-limit position indicated by solid lines in FIG. 1 and is completely apart from the rubber block 52, which is thus not deformed so that the lower surface is entirely apart from the membrane switches 51, wherein all the contacts SW1, SW2, SW3, and SW4 are turned off.

As the player gradually depresses the foot pedal 31, the movable shaft 27 moves downwards so that the core plate 54 correspondingly moves downwards to gradually depress the rubber block 52, which is thus gradually deformed from a circular arc shape to a planner shape. Therefore, the rubber block 52 sequentially presses the membrane switches 51 from the base portion 52*a* thereof, so that the contacts SW1, SW2, SW3, and SW4 are sequentially turned on in order.

When the core plate 54 completely moves down to the lower-limit position indicated by imaginary lines in FIG. 1, the rubber block 52 is completely deformed to the planar shape so that the lower surface thereof entirely depresses the membrane switches 51, wherein all the contacts SW1, SW2, SW3, and SW4 are turned on.

In the aforementioned state, when the player gradually releases depression applied to the foot pedal 31, the movable shaft 27 gradually moves upwards so that the core plate 54 correspondingly moves upwards, wherein the rubber block 52 is gradually restored to the 'original' circular arc shape so that the free end 52*b* thereof gradually moves upwards to depart from the membrane switches 51, whereby the contacts SW4, SW3, SW2, and SW1 are sequentially turned on in order.

Incidentally, it is possible to modify the present embodiment in such a way that projections each elongated in the width direction of the rubber block 52 are formed to slightly project downwards from the lower surface of the rubber block 52 at prescribed positions opposite to the contacts SW1–SW4 of the membrane switches 51 arranged in parallel on the surface of the bottom 12*a*. Thus, when the rubber block 52 is depressed by the core plate 54, it is possible to reliably turn on the contacts SW1–SW4 of the membrane switches 51.

Figure 5:
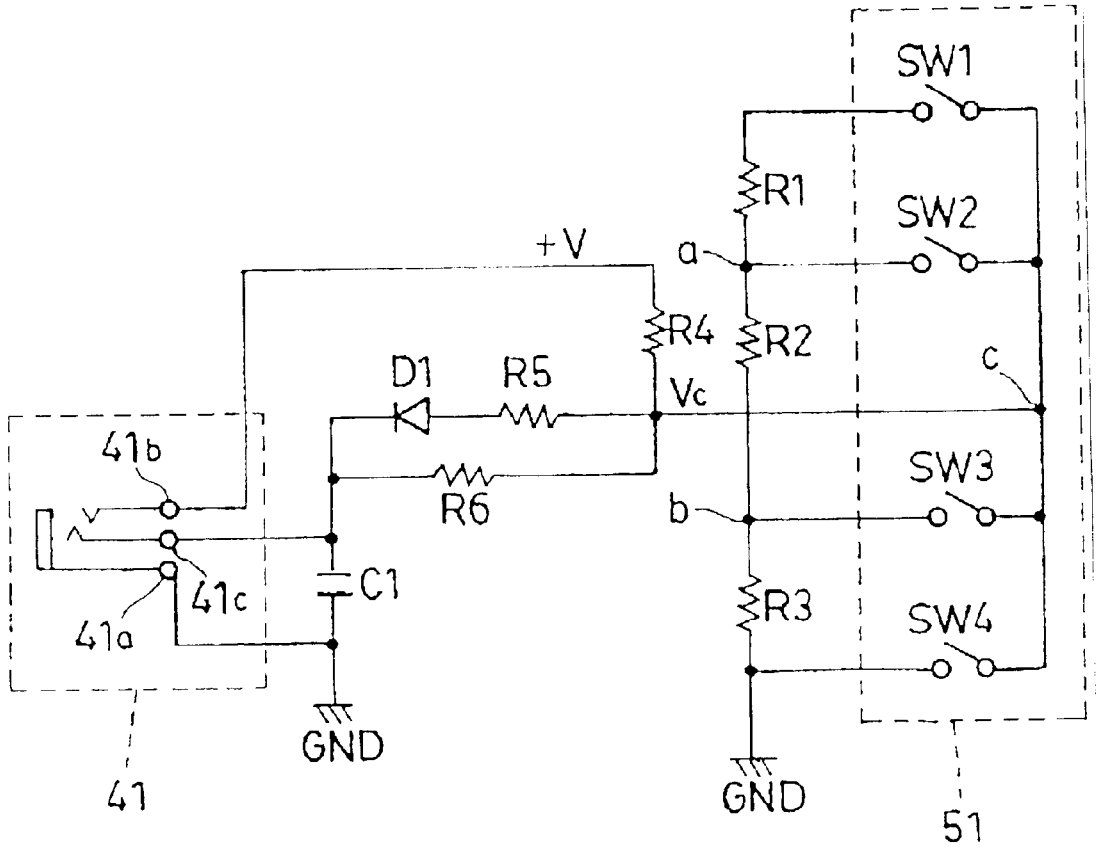
FIG. 5 is a circuit diagram showing an example of circuitry, using membrane switches, for generating a control signal.

FIG. 5 shows an example of circuitry, using the membrane switches 51, for outputting control signals for controlling electronic sounds to be produced in response to pedal operation.

In the circuitry of FIG. 5, one terminals of the contacts SW1–SW4 are all commonly connected together, wherein three resistors R1, R2, and R3 are connected in series between the other terminal of the contact SW1 and ground GND; the other terminal of the contact SW2 is connected to a connection point 'a' between the resistors R1 and R2; the other terminal of the contact SW3 is connected to a connection point 'b' between the resistors R2 and R3; and the other terminal of the contact SW4 is connected to the ground GND.

The aforementioned jack 41 has three terminals, namely, a ground terminal 41*a*, a power supply terminal 41*b*, and an output terminal 41*c*. Herein, the ground terminal 41*a* is connected with the ground GND; the power supply terminal 41*b* is connected to a common connection point 'c', at which all the contacts SW1–SW4 are commonly connected together, via a resistor R4.

Supply voltage +V is applied to the power supply terminal 41*b* of the jack 41 is divided between the resistance of the resistor R4 and other 'series' resistance, which is realized by the resistors R1–R3 that are effectively connected in series between the common connection point c and the ground GND, so that 'divided' voltage Vc emerges at the common connection point c. The divided voltage Vc is applied to the output terminal 41*c* of the jack 41 via a parallel circuit in which a series circuit consisting of a resistor R5 and a diode D1 is connected in parallel with a resistor R6, so that a control signal is output from the output terminal 41*e*, which is also connected with a capacitor C1 for noise elimination on the ground GND. The aforementioned circuitry, namely, a control signal generation circuit, can be built in the jack box 4 and the like.

The aforementioned resistors R1–R4 have respective resistances, which are also denoted by reference symbols R1–R4. When all the contacts SW1–SW4 of the membrane switches 51 are turned off, all the resistors R1–R3 are not connected between the common connection point c and the ground GND; therefore, Vc=+V (i.e., supply voltage).

When the contact SW1 is only turned on, the resistors R1–R3 are connected in series between the common connection point c and the ground GND; therefore, the voltage Vc emerging at the common connection point c is calculated as follows:

$$Vc = +V \cdot \frac{R1 + R2 + R3}{R1 + R2 + R3 + R4}$$

When both the contacts SW1 and SW2 are turned on, the resistors R2 and R3 are connected in series, so that the voltage Vc is calculated as follows:

$$Vc = +V \cdot \frac{R2 + R3}{R2 + R3 + R4}$$

When the contacts SW1–SW3 are turned on, only the resistor R3 is effectively connected between the common connection point c and the ground GND, the voltage Vc is calculated as follows:

$$Vc = +V \cdot \frac{R3}{R3 + R4}$$

When all the contacts SW1–SW4 are turned on, the common connection point c is directly connected with the ground GND; therefore, Vc=O.

When the supply voltage +V is 3 V, and all the resistors R1–R4 have the same resistance, the voltage Vc can be changed in five steps within a range from 3 V to 0 V, as follows:

3 V

3×3/4=2.25 V

3×2/3=2.0 V

3×1/2=1.5 V

0V

Based on the voltage Vc, a control signal is produced in response to pedal operation and is output from the output terminal 41*c* of the jack 41, into which a plug of a connection cable is inserted, so that the control signal is sent to a musical tone generator (not shown) via the connection cable.

Thus, an electronic sound (simulating a hi-hat sound) is produced in synchronization with a percussion detection signal from the percussion sensor 14 shown in FIG. 1 and is controlled in tone color in response to the control signal.

For example, when all the contacts SW1–SW4 are turned off, an electronic sound is controlled to have an open hi-hat tone color. When all the contacts SW1–SW4 are turned on, an electronic sound is controlled to have a closed hi-hat tone color. Herein, intermediate modes between an open hi-hat mode and a closed hi-hat mode can be realized by controlling depression applied to the foot pedal 31 within a full stroke. That is, a first intermediate mode is realized when the foot pedal 31 is slightly depressed so that the contact SW1 is turned on while the other contacts SW2–SW4 are turned off; a second intermediate mode is realized when the foot pedal 31 is depressed with a half stroke so that the contacts SW1 and SW2 are turned on while the contacts SW3 and SW4 are turned off; and a third intermediate mode is realized when the foot pedal 31 is depressed deeply so that the contacts SW1–SW3 are turned on while the contact SW4 is turned off. Herein, electronic sounds are controlled to have different tone colors simulating hi-hat sounds, which are actually produced from a hi-hat of an acoustic percussion instrument whose foot pedal is depressed differently in conformity with the aforementioned intermediate modes in which the foot pedal 31 of the electronic percussion instrument is depressed differently. Thus, it is possible to assign five types of hi-hat striking tone colors to the hi-hat 1 in response to depressed positions of the foot pedal 31.

A hi-hat of an acoustic percussion instrument can be played to produce a foot hi-hat sound by simply depressing a foot pedal, wherein a pair of cymbals collides with each other to ring. In order to simulate such a foot hi-hat sound that is produced by simply depressing the foot pedal 31 of the pedal unit 3, the present embodiment can be designed to control sound in response to a velocity of depressing the foot pedal 31.

That is, when the foot pedal 31 is rapidly depressed at a high speed (which is higher than normal velocities of depressing the foot pedal 31 to control tone colors of hi-hat striking sounds), the contacts SW1–SW4 are sequentially and rapidly turned on at a high speed, wherein an output voltage (e.g., Vc) is rapidly changed to a ground level (or zero). Upon detection of a rapid variation of the output voltage, an electronic sound is controlled to have a specific tone color simulating a hi-hat sound, which is actually produced from a hi-hat of an acoustic percussion instrument whose foot pedal is depressed similarly to a rapid depression of the foot pedal 31 of the electronic percussion instrument.

Figure 6:
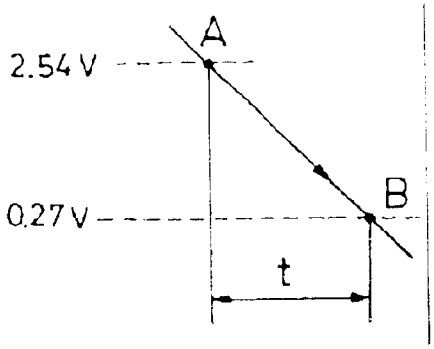
FIG. 6 shows an example of variations of an output voltage of the circuitry of FIG. 5 in order to realize a foot close sound.

FIG. 6 shows an example of variations of an output voltage (output from the aforementioned control signal generation circuit shown in FIG. 5), wherein the output voltage is initially above 2.54 V (measured at a point A before occurrence of variation) and is then reduced below 0.27 V (measured at a point B after occurrence of variation) in a time length t, which is 50 msec or less. That is, an electronic sound is controlled to simulate a foot close sound when the output voltage is rapidly changed as shown in FIG. 6.

In the above, the foot close sound can be changed in tone volume in response to the time length t, which can be varied. For example, when the time length t is 10 msec or less, the foot close sound is produced with a high tone volume like "forte". When it is 20 msec or so, the foot close sound is produced with an intermediate tone volume like "mezzo forte". When it is 50 msec or so, the foot close sound is produced with a small tone volume like "piano".

In addition, a hysteresis characteristic can be provided in order to avoid unwanted occurrence of a foot-on state when the player mistakenly depresses the foot pedal 31. That is, even when the output voltage becomes lower than 0.27 V at a point B, an electronic sound is not produced if the output voltage once becomes greater than 2.54 V at a point A.

The present embodiment can be designed to produce a so-called foot splash sound when the player rapidly depresses the foot pedal 31 and immediately releases the foot pedal 31.

Figure 7:
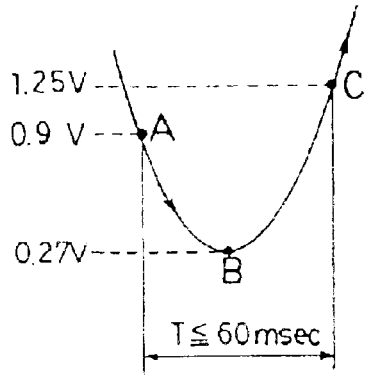
FIG. 7 shows an example of variations of an output voltage of the circuitry of FIG. 5 in order to realize a foot splash sound.

FIG. 7 shows an example of variations of an output voltage (output from the control signal generation circuit shown in FIG. 5), wherein when the player rapidly depresses the foot pedal 31, the output voltage starts to decrease from a certain value (e.g., 0.9 V) at a measurement start point A; thereafter, when the player releases the foot pedal 31, the output voltage that is at a minimal value at a point B corresponding to a depressed state of the foot pedal 31 increases to reach another value (e.g., 1.25 V) at a measurement end point C.

In the above, a foot splash sound is produced under prescribed conditions where the minimal value of the output voltage at the point B is equal to a prescribed threshold value (e.g., 0.27 V) or less, and a time T required for a variation of the output voltage from the measurement start point A to the measurement end point C is equal to a prescribed time (e.g., 60 msec) or less.

As described above, it is possible to control electronic sounds in response to depression of the foot pedal 31. Therefore, it is possible to selectively produce desired hi-hat sounds in response to depression of the foot pedal 31.

The present embodiment is designed in such a way that the core plate 54 is moved up and down by way of the movable shaft 27 in response to depression of the foot pedal 31. This provides a player (or a user) of an electronic percussion instrument with real performance feelings similar to those of an acoustic percussion instrument in which a foot pedal is depressed to move up and down an upper (mobile) cymbal of a hi-hat by way of a movable shaft. Incidentally, it is possible to impart a specific mass (or weight) simulating the mobile cymbal of an acoustic hi-hat to the core plate 54. In this case, a sensation of depressing the foot pedal 31 can be made realistic and further close to a sensation of depressing a foot pedal of an acoustic hi-hat.

In addition, the present embodiment allows the player to further depress the foot pedal 31 so that the core plate 54 depresses the rubber block 52 towards the membrane switches 51, wherein the player can have real performance feelings simulating those of a hi-hat of an acoustic percussion instrument in which an upper mobile cymbal is brought into contact with a lower fixed cymbal under pressure.

The aforementioned control signal output device 5 is not arranged close to the pedal unit 3 but is arranged in proximity to the hi-hat 1; therefore, it is possible to arbitrarily use an ordinary hi-hat stand and a foot pedal, which are sold on the market, for a hi-hat of an electronic percussion instrument similarly to a hi-hat of an acoustic percussion instrument. That is, the present embodiment allows a human operator (or a user) to easily fix the hi-hat 1 to the hi-hat stand generally sold on the market.

The present embodiment is designed in such a way that the membrane switches 51 including four contacts SW1–SW4 are arranged in parallel so as to produce different signal values in response to degrees of deformation of the rubber block 52 interlocked with pedal operations. Of course, it is possible to set an arbitrary number of contacts for the membrane switches 51. Alternatively, it is possible to use a stepless sensor such as a pressure sensitive sensor, which can be substituted for the membrane switches 51.

In addition, it is possible to install a distortion sensor in an elastic material such as the rubber block 52, so that distortion of the elastic material is detected to produce a detection signal. Furthermore, it is possible to use an optical sensor such as a reflective photo-sensor, which detects displacement of the core plate 54 or the elastic material to produce a detection signal.

In the present embodiment, two rubber blocks 52 and 53 both having substantially the same shape are arranged on the bottom 12*a* under the core plate 54 to be symmetrically about the movable shaft 27. Thus, the core plate 54 can securely depress the rubber block 52 with a good balance. That is, it is not necessary to arrange a single dummy rubber block 53 in proximity to the rubber block 52 on the bottom 12*a*. In other words, it is possible to arrange three or more rubber blocks, including the rubber block 52, for operating the membrane switches 51, wherein these rubber blocks are arranged with equal distances therebetween in a concentric manner about the movable shaft 27.

In the above, a plurality of rubber blocks, including the rubber block 52, are all depressed with the same pressure, so that they are all subjected to aging deterioration similarly. That is, even though rubber blocks deteriorate during aging, the core plate 54 can securely depress all the rubber blocks with a good balance. Incidentally, it is possible to reduce aging deterioration by increasing the number of rubber blocks.

The elastic material (e.g., rubber block 52) for causing sensors such as membrane switches 51 to produce signals is not necessarily made as a rubber block but can be made of other materials or formed in other shapes.

In the present embodiment described above, the core plate 54 depresses the rubber block 52 to come in contact with the membrane switches 51 arranged thereunder, so that on/off states of the membrane switches 51 are detected to control electronic sounds in tone colors. In addition, the dummy rubber block 53 is arranged opposite to the rubber block 52 with respect to the movable shaft 27, so that the core plate 54 is balanced due to uniform depression applied to the rubber block 52 and the dummy rubber block 53. It is possible to modify the present embodiment as shown in FIG. 8 in such a way that a movable shaft is inserted into a hole of a rubber block and can be freely moved up or down through the rubber block, wherein a balancer is arranged to encompass the rubber block.

Figure 8:
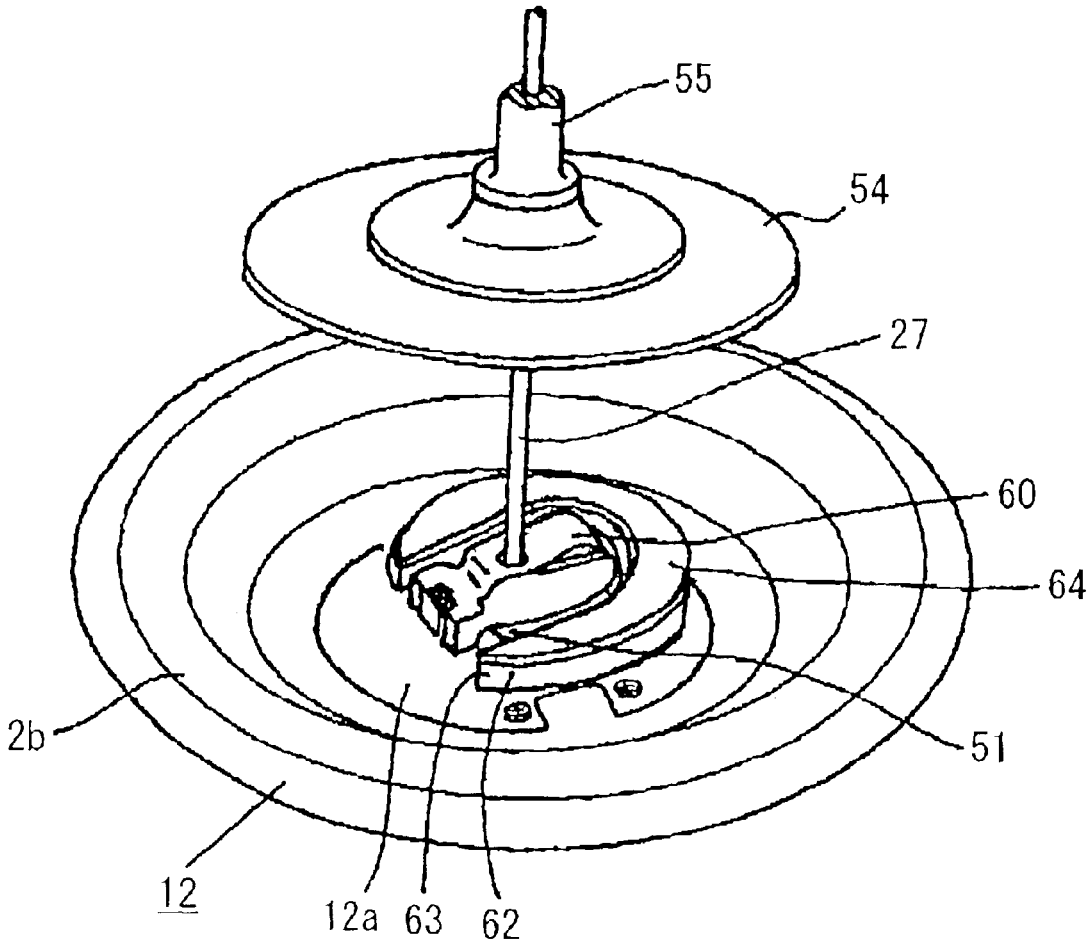
FIG. 8 is a perspective view showing essential parts of a modified example of the hi-hat of the electronic percussion instrument.

Specifically, a modified example of the hi-hat 1 shown in FIG. 8, in which parts identical to those shown in FIG. 3 are designated by the same reference numerals, is characterized in that a rubber block 60 similar to the foregoing rubber block 52 is arranged at approximately the center of the bottom 12*a* of the lower portion 12 of the hi-hat 1, wherein a hole 61 allowing the movable shaft 27 to penetrate therethrough is formed through the center of the rubber block 60. Herein, the movable shaft 27 is inserted into the hole 61 of the rubber block 60 and is moved up or down while being guided by the hole 61 of the rubber block 60.

In addition, a balancer 62 is arranged to encompass the rubber block 60 on the bottom 12*a* of the lower portion 12 of the hi-hat 1, wherein the interior wall thereof has roughly a horseshoe shape to surround the exterior surface of the rubber block 60, while the exterior wall thereof has roughly a circular arc shape. Approximately a U-shape gap is formed between the exterior wall of the rubber block 60 and the interior wall of the balancer 62 so as not to unnecessarily restrict movement of the rubber block 60 when depressed by the core plate 54. The balancer 62 is constituted by a base 63, made of a synthetic resin, and a rubber layer 64, which are adhered to each other using an adhesive, wherein the upper surface of the balancer 62 is made substantially planar. The height of the balancer 62 is slightly lower than the initial height of the rubber block 60 that is not depressed, and it may substantially match the lowest elevation of the core plate 54. Therefore, even when the rubber block 60 is irregularly deformed while being twisted, the balancer 62 can reliably receive the core plate 54 in a stable manner.

Next, the overall operation of the aforementioned hi-hat 1 shown in FIG. 8 will be described. When the player depresses the foot pedal 31, the movable shaft 27 correspondingly moves down so that the free end of the rubber block 60 is depressed and deformed. Similar to the foregoing embodiment shown in FIG. 3, the rubber block 60 is gradually deformed from the base portion thereof so that the membrane switches 51 arranged thereunder are sequentially brought into contact with the lower surface of the rubber block 60, whereby the contacts SW1, SW2, SW3, and SW4 are sequentially turned on in order. When the free end of the rubber block 60 is depressed and deformed, the uppermost portion of the "deformed" rubber block 60 also descends down to substantially match the balancer 62 in height. At this time, the core plate 54 comes in contact with the rubber layer 64 of the balancer 62, which is also elastically deformed, wherein a deformation value of the rubber layer 64 is relatively small compared with a deformation value of the rubber block 60. Therefore, when the core plate 54 comes in contact with the balancer 62, the core plate 54 would not further descend down because the balancer 62 acts as a stopper for avoiding further descending of the core plate 54.

As described heretofore, this invention has a variety of effects and technical features, which will be described below.

(1) This invention guarantees real performance feelings in playing a hi-hat of an electronic percussion instrument similarly to those of a hi-hat of an acoustic percussion instrument, thus producing a variety of sounds such as an open hi-hat sound, a closed hi-hat sound, and a foot hi-hat sound, for example. That is, an electronic percussion instrument of this invention is constituted by a pedal unit, a stand, and a hi-hat, which are integrally interconnected together in a vertical direction, wherein a depressing member (e.g., a core and a core plate) having a prescribed mass is moved up or down via a movable shaft upon a pedal operation, thus producing a control signal for controlling a tone color of a hi-hat sound. Therefore, the player (or user) can experience a satisfactory sensation in playing an electronic percussion instrument similarly to that of an acoustic percussion instrument.

(2) Specifically, sensors are arranged on a lower portion of a hi-hat and are accompanied with an elastic member so as to produce signals in response to displacement or deformation of the elastic member, which is depressed by the depression member upon a pedal operation. Herein, the elastic member is made of a rubber block that is curved upwardly, wherein one end of the rubber block is fixed to a prescribed position of the lower portion of the hi-hat, while membrane switches are used as sensors and are arranged beneath the rubber block, so that membrane switches are selectively turned on or off in a step-by-step manner due to displacement or deformation of the rubber block.

(3) In the above, sensors for producing signals in response to displacement or deformation of the elastic member are not necessarily limited to membrane switches; therefore, it is possible to use other sensors such as pressure sensitive sensors, distortion sensors, and optical sensors (e.g., reflective photo-sensors). In addition, sensors are not necessarily turned on or off in a step-by-step manner; therefore, it is possible to produce a continuously varying signal in a stepless manner.

(4) When the weight of the depression member substantially matches the weight of a cymbal of an acoustic percussion instrument, it is possible to make a sensation of operating a foot pedal similar to that of a foot pedal interlocked with a hi-hat of an acoustic percussion instrument.

(5) It is possible to arrange a plurality of elastic members, which are all depressed by the depression member, to be symmetrically about the movable shaft. Alternatively, it is possible to arrange them with equal distances therebetween in a concentric manner about the movable shaft. Thus, it is possible to stabilize operation in depressing elastic members with a good balance, wherein compared with a hi-hat using a single elastic member, it is possible to reduce aging deterioration of elastic members, which may be equally deteriorated during aging; therefore, it is possible to guarantee a good balance in performing a hi-hat, regardless of aging deterioration.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. An electronic percussion instrument comprising:

a hi-hat having a percussion sensor;

a stand for vertically supporting the hi-hat thereon;

a foot pedal arranged beneath the stand, wherein the foot pedal is interlocked with the hi-hat via a movable shaft, which is moved up or down in response to an operation of the foot pedal, and wherein the hi-hat cooperates with the percussion sensor to activate generation of an electronic sound, which is controlled in tone color in response to a vertical movement of the movable shaft interlocked with the foot pedal;

a depression member interlocked with the movable shaft;

an elastic member that is depressed by the depression member when the movable shaft moves downwards upon depression of the foot pedal; and a sensor for producing a signal in response to displacement or deformation of the elastic member.

2. An electronic percussion instrument according to claim 1, wherein the elastic member is constituted by a rubber block one end of which is fixed to a prescribed position of a lower portion of the hi-hat and the other end of which is normally curved upwardly, and wherein the sensor is constituted by a plurality of membrane switches that are arranged beneath the rubber block, so that when the rubber block is depressed by the depression member, the plurality of membrane switches are sequentially turned on or off in a step-by-step manner in response to displacement or deformation of the rubber block.

3. An electronic percussion instrument according to claim 1, wherein the depression member is constituted by a core plate whose weight is adjusted to simulate a real weight of a cymbal.

4. An electronic percussion instrument according to claim 2, wherein at least one rubber block is additionally arranged in proximity to the rubber block corresponding to the elastic member under which the plurality of membrane switches are arranged.

5. An electronic percussion instrument comprising:

a support member;

a movable shaft extending through the support member;

a pressing member coupled to the movable shaft;

a plurality of switches disposed on the support member, the plurality of switches outputting electric signals therefrom; and a flexible member disposed on the support member, the flexible member having a lower surface, the flexible member being deflected by the pressing member upon movement of the movable shaft, wherein the lower surface is sequentially brought into contact with the plurality of switches upon deflection of the flexible member.

6. An electronic percussion instrument according to claim 5, wherein the pressing member is constituted by a circular plate fixed to the movable shaft.

7. An electronic percussion instrument according to claim 5 further comprising a balancing member disposed on the support member, the balancing member being brought into contact with the pressing member together with the flexible member.

8. An electronic percussion instrument according to claim 7, wherein the balancing member has a flexible member that deflects by being pressed by the pressing member.

9. An electronic percussion instrument according to claim 8, wherein the flexible member of the balancing member is arranged opposite to the flexible member with respect to the movable shaft.

10. An electronic percussion instrument according to claim 7, wherein the balancing member has an arc shape configuration and has a planar surface thereon.

11. An electronic percussion instrument according to claim 10, wherein the balancing member comprises a base and a rubber layer, which is formed on the base.

12. An electronic percussion instrument according to claim 5, wherein the flexible member has a hole penetrating therethrough, so that the movable shaft is inserted into the hole to be movable through the hole.

13. An electronic percussion instrument comprising:

a hi-hat having a percussion sensor;

a stand for vertically supporting the hi-hat thereon;

a foot pedal arranged beneath the stand;

a movable shaft coupled to the foot pedal; and a shaft sensor sensing vertical movement of the movable shaft, wherein the hi-hat cooperates with the percussion sensor to activate generation of an electronic sound, which is controlled in tone color in response to an output signal of the shaft sensor.

* * * * *